United States Patent [19]

von Beck

[11] 4,349,069

[45] Sep. 14, 1982

[54] REGENERATIVE AIR HEATER

[75] Inventor: Harold F. V. von Beck, Bullhead City, Ariz.

[73] Assignee: Combustion Engineering, Inc., Windsor, Conn.

[21] Appl. No.: 266,245

[22] Filed: May 22, 1981

[51] Int. Cl.[3] ..... F28D 17/00

[52] U.S. Cl. ..... 165/4; 165/5; 165/7

[58] Field of Search ..... 165/4, 7

[56] References Cited

U.S. PATENT DOCUMENTS 1,845,239 2/1932 Colby ..... 165/4

2,892,616 6/1959 Firgau ..... 165/7

3,741,286 6/1973 Muhlrad ..... 165/9.3 X

*Primary Examiner*—Albert W. Davis

*Attorney, Agent, or Firm*—William W. Habelt

[57] ABSTRACT

Regenerative heat exchange apparatus (12) for the transfer of heat from a heating fluid (hot gas) to a fluid to be heated such as air. Valve means (16-A, 18-A, 22-A, 24-A) control the flow of heating fluid and the fluid to be heated to and through their respective ducts in the heat exchanger. A bypass duct (38) reversely directs heating fluid through the heat exchanger (12) to displace heated air trapped therein after the valve (24-A) controlling the air supply has been closed.

5 Claims, 1 Drawing Figure

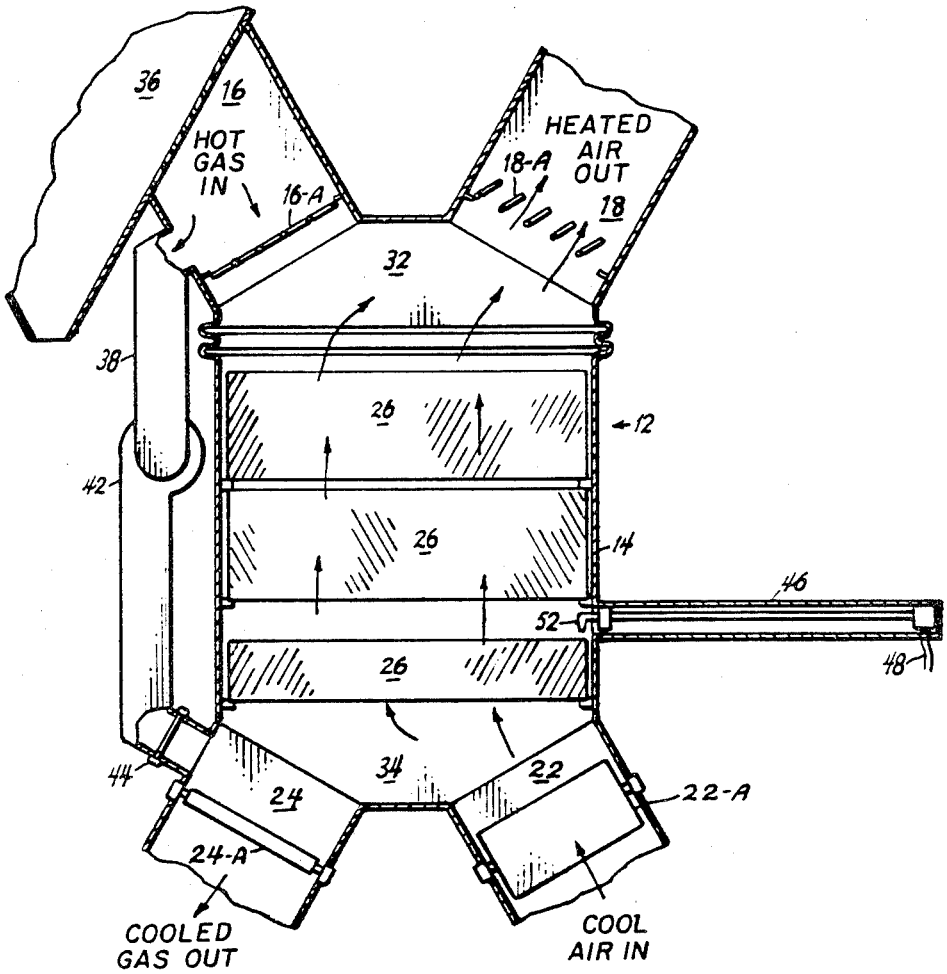
36
16
HOT GAS IN
16-A
HEATED AIR OUT
18-A
18
32
38
26
12
42
26
14
46
52
48
26
44
34
22
22-A
24
24-A
COOLED GAS OUT
COOL AIR IN

REGENERATIVE AIR HEATER

BACKGROUND OF THE INVENTION

1. Field of the Invention

The invention relates to regenerative heat exchangers in which a fixed mass of heat absorbent material is alternately subjected to the flow of hot gas and cooler air in order that heat content of the gas may be transferred to the cool air through the intermediary of the heat absorbent material. Valves which direct the flow of air and gas to and from a fixed mass of heat exchange element are sequentially opened and closed to obtain the desired cycle of operation. An inherent defect in this type of apparatus lies in the fact that a quantity of heated fluid always remains in the heat exchanger after valves which control such flow therethrough are closed. Upon directing a succeeding fluid through the heat exchanger, the fluid entrained in the heat exchanger is then pushed out of the heat exchanger by said fluid and exhausted to the atmosphere to be forever lost.

Inasmuch as air when heated, then lost represents a loss of effectiveness, it is also an economic loss since it requires larger fans which in turn require more power. This patent attempts to alleviate this situation by providing an arrangment that forces entrained air to flow to its original destination for full utilization.

2. Description of the Prior Art

U.S. Pat. Nos. 1,845,239 and 3,741,286 are directed to valve type regenerator arrangements that disclose known arrangements for purging entrained gas from passageways within the regenerator. Although such arrangements might be modified to similarly purge entrained air from the heat exchanger, they would not provide the simple but effective arrangement herein disclosed.

SUMMARY OF THE INVENTION

This invention is therefore directed to an arrangement for a valve type regenerative heat exchanger that effectively utilizes all of the fluid that has been heated by contact with a heat absorbent mass therein. More specifically, the invention is directed to an arrangement for operating a regenerative heat exchanger that results in loss to the atmosphere of a minimum amount of the heat content thereof by either direct or entrained leakage.

According to the invention suitable ducting including a recirculation fan is adapted to direct a quantity of hot gas through the heat exchanger in the same direction and immediately after a quantity of cooler air has been directed through the heat exchanger and over a quantity of hot heat absorbent material therein. The hot gas pushes the hot air ahead to its intended place of use before it is permitted to become entrained in the normal flow of exhaust gases being exhausted to the atmosphere.

BRIEF DESCRIPTION OF THE DRAWING

The single FIGURE is a cross-sectional view of a heat exchanger having a gas recirculation fan as disclosed in the present invention.

DESCRIPTION OF THE PREFERRED EMBODIMENT

In the drawing the numeral 12 represents a regenerative heat exchange apparatus having a housing 14 that includes an inlet duct 16 for heating fluid and an outlet duct 18 for heated air at what is called the "hot end" of the heat exchanger. At the spaced or remote end of the heat exchanger is an inlet duct 22 for cool air and an outlet duct 24 for heating fluid that has traversed the mass of heat absorbent material 26 in the housing and is being exhausted as cooled fluid. Chambers in the housing 14 at spaced ends of the mass of heat absorbent material 26 define the "hot end" plenum chamber 32 and the "cold end" plenum chamber 34.

A source of the heating fluid 36 customarily defined as a boiler-furnace, a steel converter or the like normally exhausts gases therefrom containing a substantial heat content directly to the atmosphere. This invention defines an arrangement whereby hot gases from inlet duct 16 first flow into and through the heat absorbent material 26 before being exhausted from housing 10 through outlet duct 24 to the atmosphere.

In accordance with conventional practice, valve means in the inlet and outlet ducts for the heating fluid (hot gas) and the fluid to be heated (cool air) are adapted to control the flow of the respective fluids through the heat exchanger. Thus valve 16-A in the gas inlet duct 16 and valve 24-A in outlet duct 24 for cooled gas are at first open while valve 22-A in cool air inlet duct 22 and valve 18-A in heated air outlet duct 18 are fully closed. The heating fluid from source 36 will accordingly flow through the heat exchanger and impart heat to the heat absorbent material 26 therein. After a predetermined period of operation in this manner, valves 16-A and 24-A are closed and valves 18-A and 22-A are opened so as to direct a stream of cool air over the hot heat absorbent material whereby the cool air is heated by contact therewith and then directed out through duct 18 to its place of use.

In the usual manner of operation, the valves 22-A and 18-A are then closed and valves 24-A and 16-A opened to again direct the heating fluid through the heat exchanger. Partially heated air from inlet 22 entrained in the heat exchanger element at the beginning of this cycle is driven out by the heating fluid and, along with the cooled hot gases, it is exhausted to the atmosphere.

Inasmuch as air trapped in the heat exchanger by the closing of valves 22-A and 18-A represents a substantial part of the air flowing through the heat exchanger, the loss of this air, when heated, represents a substantial loss in the effectiveness of the heat exchanger.

According to this invention, a bypass duct 38 forms a flow passageway between the inlet duct for heating fluid 16 and the cold air plenum chamber 34 whereby a quantity of heating fluid may be supplied to plenum chamber 34. Inasmuch as the air pressure of the cool air in chamber 34 may be substantially greater than that of the hot gas in duct 38, a blower 42 is provided to increase the inlet pressure of the hot gas whereby it will freely flow through control valve 44 and into cold air plenum chamber 34.

Accordingly, after the air flow through element 26 has been terminated and housing 14 remains full of heated air, valve 22-A is closed along with valves 16-A and 24-A, while valve 18-A is held in an open position. Purging damper 44 is then opened and a stream of heating fluid from source 36 is directed into plenum chamber 34. As the heating fluid enters housing 14 it displaces the hot air and forces it to be pushed ahead through open valve 18-A and duct 18 to its place of intended use. After a time determined to take heating fluid supplied through duct 38 to displace the air in housing 10, the valves 18-A, 22-A and 44 are closed and again valves 16-A and 24-A are opened to direct the flow of heating fluid through the heat exchanger to impart the heat content thereof to the heat absorbent material.

This cycle of operation is continuously repeated whereby after each flow of air over the heated element within the heat exchanger, there is a predetermined period when a controlled flow of hot gas is directed through the heat exchanger in the same direction as normal air flow through the heat exchanger, whereby the gas will push the heated air ahead of it so as to evacuate all the air from within the heat exchanger. Upon closing bypass valve 44, cool air inlet valve 22-A and heated air outlet valve 18-A while opening inlet valve 16-A and outlet valve 24-A, heating fluid from source 36 will again be directed over the element 26 to commence a new cycle of operation.

A cleaning means 46 reciprocable in the space between blocks of heat absorbent element between "hot" and "cold" ends of the heat exchanger is adapted to apply pressurized cleaning fluid from a source 48 through nozzle 52 and over the "cold" end element where greatest concentration of deposits occurs.

Conventional timing-actuating means is adapted to control valves 44, 22-A and 24-A according to a timing sequence determined to provided maximum effectiveness.

I claim:

1. Regenerative heat exchange apparatus including a housing, an inlet duct for a heating fluid and an outlet duct for heated air connected to one end of the housing to define a hot end of the heat exchanger, an outlet duct for cooled fluid and an inlet duct for cool air connected to the remote end of the heat exchanger to define a cold end therefor, a mass of heat absorbent material in said housing spaced from the ends thereof to define a hot end plenum chamber adjacent the inlet for the heating fluid and cold end plenum chamber adjacent the inlet for cool air, a source of heating fluid, a passageway connecting the source of heating fluid to the inlet duct for heating fluid, valve means in the inlet and outlet ducts for the heating fluid and air adapted to control the flow of fluid therethrough, a bypass duct connecting said passageway to the cold end plenum chamber, valve means in the bypass duct controlling the flow of heating fluid therethrough, and a blower in said bypass duct having an inlet connected to the source of heating fluid and an outlet exhausting heating fluid into the cold end plenum chamber at a pressure that exceeds the pressure of the air in said housing.

2. Regenerative heat exchange apparatus as defined in claim 1 wherein the valves controlling the flow of heating fluid into the hot end plenum chamber and the heated air exhausting therefrom are automatic check valves actuated by an excess of pressure.

3. Regenerative heat exchange apparatus as defined in claim 2 wherein the check valve controlling the flow of heating fluid into the hot end plenum chamber is actuated by an excess of air pressure in said housing.

4. Regenerative heat exchange apparatus as defined in claim 3 wherein the check valve controlling the flow of heated air exhausting from the heat exchanger is closed by an excess of pressure downstream therefrom.

5. Regenerative heat exchange apparatus as defined in claim 4 wherein the check valve controlling the flow of heated air exhausting from the hot end plenum chamber is adapted to open when the check valve controlling the flow of heating fluid into the heat exchanger is closed by an excess of fluid pressure in the heat exchanger.

* * * * *